United States Patent [19]

Rubin et al.

[11] Patent Number: 4,973,299

[45] Date of Patent: Nov. 27, 1990

[54] SEPARATION

[75] Inventors: Leslie S. Rubin, Newton; Andrew C. Harvey, Lexington, both of Mass.

[73] Assignee: Foster-Miller, Inc., Waltham, Mass.

[21] Appl. No.: 395,954

[22] Filed: Aug. 18, 1989

[51] Int. Cl.[5] ..... B04B 1/04; B04B 11/00

[52] U.S. Cl. ..... 494/44; 494/35; 494/75; 494/79

[58] Field of Search ..... 494/44, 38, 74, 75, 494/76, 79, 31, 32, 35, 80; 210/781, 782, 360.1

[56] References Cited

U.S. PATENT DOCUMENTS 2,138,467 11/1938 Ayres ..... 494/75

3,861,584 1/1975 Dudrey ..... 494/44

*Primary Examiner*—R. W. Jenkins

*Attorney, Agent, or Firm*—Fish & Richardson

[57] ABSTRACT

A liguid separation system includes a first separator unit, a second separator unit and means including a pump for flowing a liquid mixture from a system inlet to the inlet of the first separator unit. A first outlet of the first separator unit is connected to the inlet of the second separator unit, a second outlet of said second separator unit is connected to the inlet of the first separator unit, a first outlet of the second separator unit is connected to a system outlet, and feedback means is adapted to provide continuous flow during system operation of at least about 0.01 gallon per minute from a second outlet of the second separator unit to the inlet of the first separator unit. The first separator unit includes a separation chamber and a control chamber in communication with the separation chamber for receiving a light constituent of the mixture, and control means responsive to a predetermined quantity of the light constituent in the control chamber for discharging a portion of the light constituent from the first separator unit. The second separator unit includes housing structure, a bowl assembly mounted for rotation in the housing structure, and means for rotating the bowl assembly at a speed of at least one thousand rpm. The bowl assembly includes structure defining an inner chamber region in which a plurality of accelerating vanes are radially disposed in the inner chamber region, and structure defining an outer chamber region surrounding the inner chamber region in which a circumferential array of coalescing vanes ae disposed.

32 Claims, 6 Drawing Sheets

SEPARATION

This invention relates to systems for separations of liquids, and particularly to systems particularly adapted for separating oil or like liquid from water.

There is a need for oil-water separator systems which will remove oil from oil water mixtures such as those encountered in environmental spills or in applications such as shipboard, bilge water, ballast water, and recovery of oil from oil spills at sea. Through flow requirements and concentrations of oil in the input mixture and in the discharge water are dependent on the particular application.

In accordance with one aspect of the invention, there is provided a liquid separation system that includes a first separator unit that has an inlet, a first outlet for a heavy constituent and a second outlet for a light constituent, a second separator unit that has an inlet, a first outlet for a heavy constituent and a second outlet for a light constituent, a system inlet and means including a pump for flowing a liquid mixture from the system inlet to the inlet of the first separator unit. The first outlet of the first separator unit is connected to the inlet of the second separator unit, the second outlet of said second separator unit is connected in feedback relation to the inlet of the first separator unit and is adapted to provide a continuous feedback flow at a rate of at least about 0.01 gallon per minute, and the first outlet of the second separator unit is connected to a system outlet.

Preferably, the first separator unit includes a separation chamber and a control chamber in communication with the separation chamber for receiving the light constituent of the mixture, and control means responsive to a predetermined quantity of the light constituent in the control chamber for discharging a portion of the light constituent from the first separator unit. The second separator unit preferably includes housing structure, a bowl assembly mounted for rotation in the housing structure, and means for rotating the bowl assembly at a speed of at least one thousand rpm. The bowl assembly includes structure defining an inlet, structure defining an inner chamber region, a plurality of accelerating vanes radially disposed in the inner chamber region, structure defining an outer chamber region surrounding the inner chamber region, and a circumferential array of coalescing vanes disposed in the outer chamber region, each coalescing vane being disposed along a path that extends circumferentially between the inner and outer walls of the outer chamber region. Passage structure provides communication between the inner chamber region and the axial inlet end of the outer chamber region, first outlet passage structure at the axial outlet end of the outer chamber region adjacent the outer periphery thereof flows a separated heavy constituent of the mixture from the outer chamber region, and second outlet passage structure at the axial outlet end of the outer chamber region adjacent the inner periphery thereof is adapted to continuously (rather than intermittently in response to a pressure or volume sensor, for example) flow a separated lighter constituent of the mixture from the outer chamber region back to the first separator unit.

In a particular embodiment, the first separator unit includes a series of plates for separating the light constituent from the heavy constituent of the mixture, and the second separator unit includes first fixed discharge structure in communication with the first outlet passage structure that receives the separated heavy constituent and discharges the separated heavy constituent from the separation apparatus, second fixed discharge structure in communication with the second outlet passage structure that receives and discharges the lighter constituent from the separation apparatus, and dynamic seal structure carried by the bowl assembly and cooperating with the first and second fixed discharge structures for maintaining separation between the light and heavy constituents applied to the first and second discharge structures.

In accordance with another aspect of the invention, there is provided separation apparatus that includes housing structure, a bowl assembly mounted for rotation in the housing structure, and means for rotating the bowl assembly at a speed of at least one thousand rpm. The bowl assembly includes structure defining an inlet, structure defining an inner chamber region, a plurality of accelerating vanes disposed in the inner chamber region, structure defining an outer chamber region surrounding the inner chamber region, and a circumferential array of coalescing vanes disposed in the outer chamber region, each coalescing vane being disposed along a path that extends circumferentially between the inner and outer walls of the outer chamber region. Passage structure adjacent the bottom of the inner chamber region provides communication with the outer chamber region, first outlet passage structure at the upper end of the outer chamber region adjacent the outer periphery thereof flows a separated heavy constituent of the mixture from said outer chamber region, and second outlet passage structure at the upper end of the outer chamber region adjacent the inner periphery thereof flows a separated light constituent of the mixture from the outer chamber region, first fixed discharge structure in communication with the first outlet passage structure receives the separated heavy constituent and discharges that separated heavy constituent from the separation apparatus, second fixed discharge structure in communication with the second outlet passage structure receives and discharges the lighter constituent from the separation apparatus, dynamic seal structure carried by the bowl assembly cooperates with the first and second fixed discharge structures and maintains separation between the light and heavy constituents applied to the first and second discharge structures when the bowl assembly is being driven in rotation, and lip seal structure cooperates with discharge structure and maintains separation between the housing and bowl assembly when the bowl assembly is not being driven in rotation to facilitate reverse flow flushing, for example.

In a particular embodiment, the inner and outer chamber defining structures include a cylindrical member that divides the inner and outer chamber regions, and the coalescing vanes, at least fifty in number, are of oleophillic polymeric material, are disposed in circumferential array and are fixedly attached to the cylindrical member. The density of the coalescing vanes is substantially the same as the density of water so that mechanical stress is minimized. The first and second fixed discharge structures each include a tubular discharge passage, the tubular discharge passages being disposed in coaxial relation, and the inlet includes a tubular conduit coaxially disposed within the tubular discharge passages. The dynamic seal structure includes a member of polymeric material with spiral groove structure disposed in running engagement with a cylindrical outer surface of one of the fixed discharge structures. Each fixed discharge structure includes a body member in which is formed a plurality of flow channels of spiral configuration that extend inwardly from inlet ports at the periphery of the discharge structure to discharge ports adjacent the center of the discharge structure and that communicate with an axially extending flow passage.

Other features and advantages will be seen as the following description of a particular embodiment progresses, in conjuction with the drawings, in which.

Figure 2:
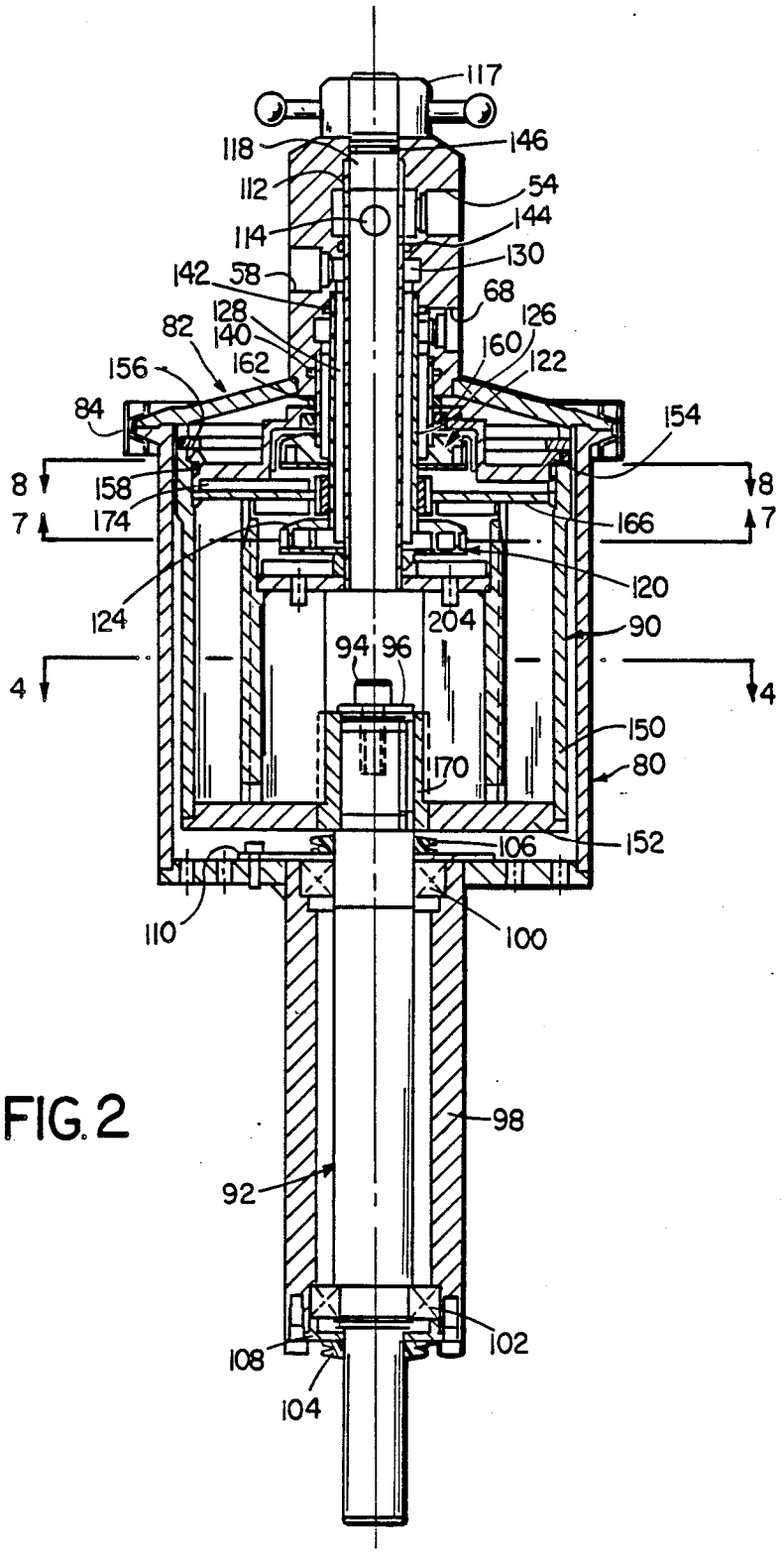
FIG. 2 is a sectional view of separation apparatus employed in the system shown in FIG. 1.
Figure 6:
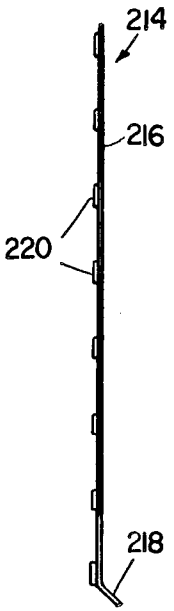
Figure 5:
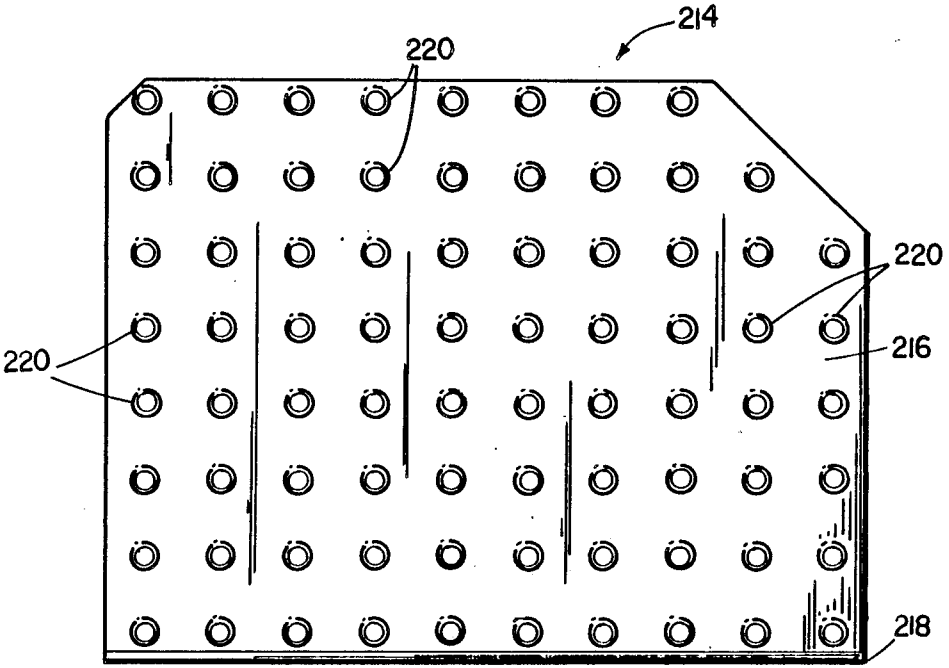
Figure 7:
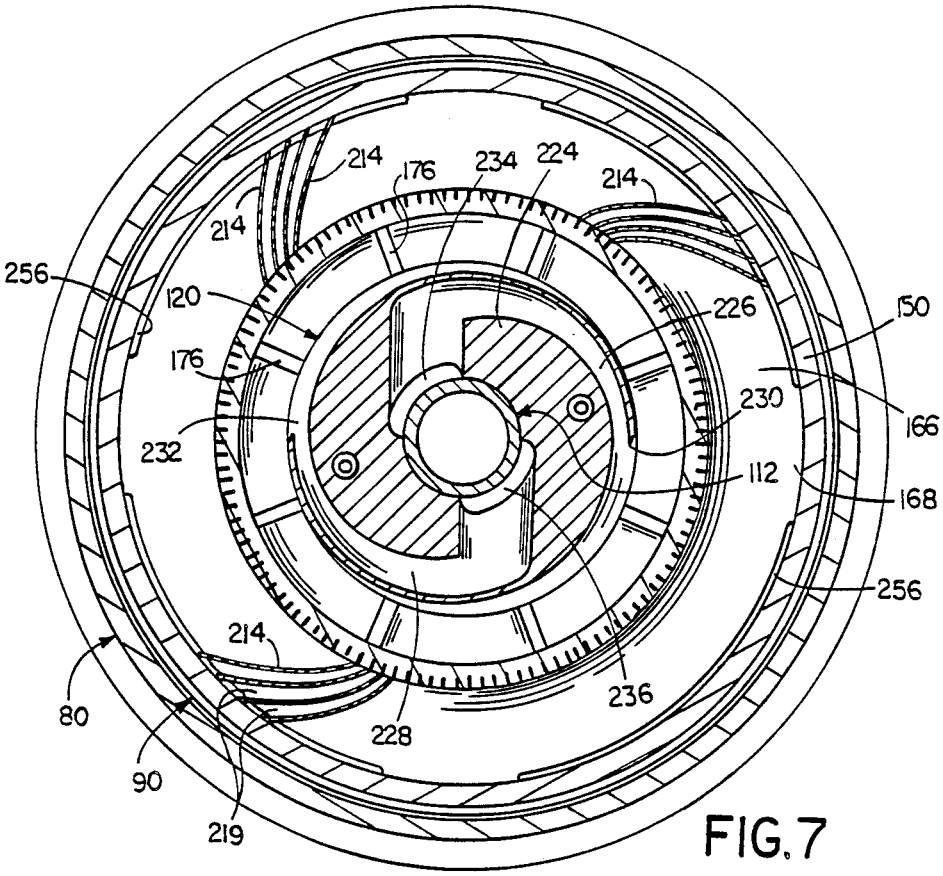
Figure 8:
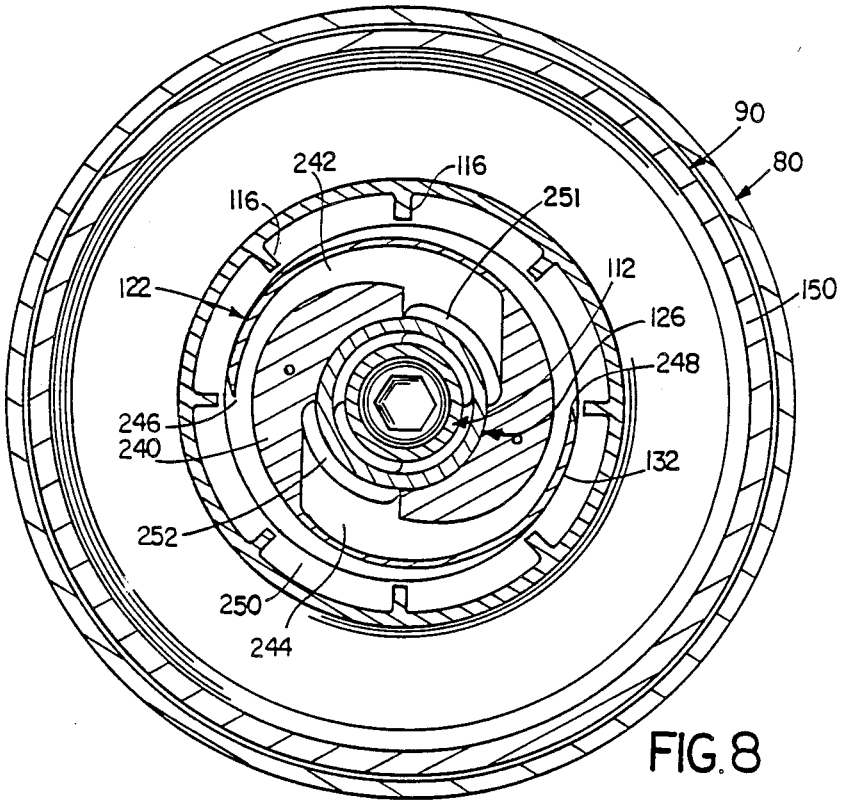

FIGS. 5 and 6 are side and end views, respectively, of a coalescer vane employed in the apparatus shown in FIG. 2; and FIGS. 7 and 8 are sectional views taken along the lines 7—7 and 8—8, respectively, of FIG. 2.

DESCRIPTION OF PARTICULAR EMBODIMENT

Figure 1:
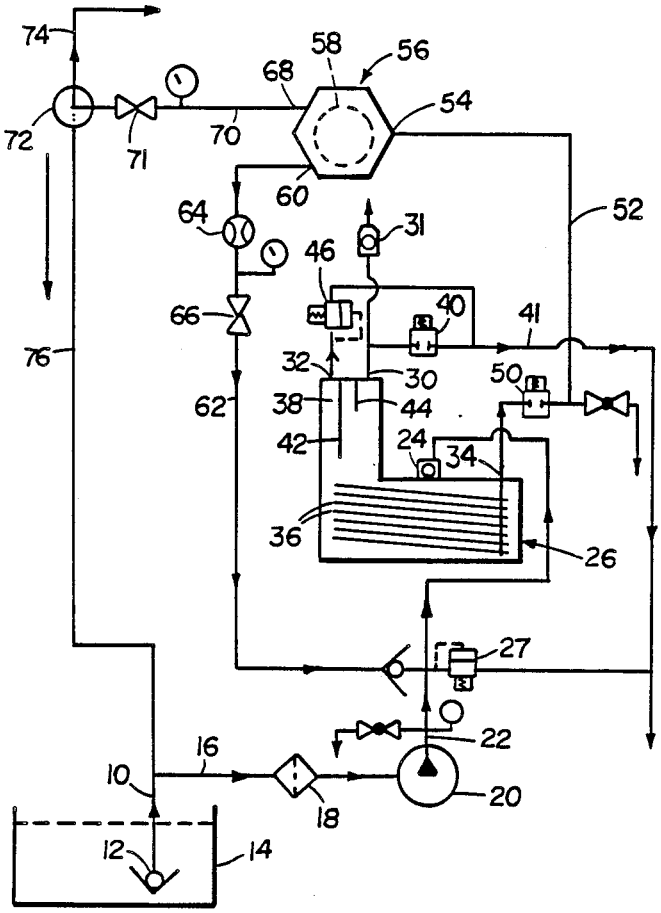
FIG. 1 is a flow diagram of a separation system in accordance with the invention.

The system shown in FIG. 1 includes inlet line 10 that includes check valve 12 disposed in bilqe region 14. Pipe 16 is connected through strainer 18 to one quarter horsepower bilge pump 20, a positive displacement progressive cavity pump of stainless steel with a stator constructed from nitrile rubber that provides a twenty psi, one gallon per minute flow at 430 rpm. The outlet of pump 20 is connected by line 22 to inlet 24 of plate separator unit 26 that has a design pressure of 6 psig and a flow rate from 0 to 3.1 gallons per minute. Unit 26 has inlet 24, oil outlet 30 that is connected to chamber vent 31, oil outlet 32 and water outlet 34. Disposed in unit 26 are a series of twenty parallel closely spaced perforated plates 36 that are slanted upwardly and tilted laterally, and that reduce settling distance of particles in the inlet flow. Oil particles rise to and collect on the undersides of plates 36 and then flow along the plates and upwardly into tower chamber 38. Removal of oil from tower chamber 38 is through valve 40 which is controlled by conductivity probes 42, 44 and through bypass valve 46. The difference in length of the two electrodes is approximately seven centimeters. Discharge control valves 40, 50 are solenoid valves constructed of stainless steel.

The outlet 34 of separator 26 is connected through valve 50 and line 52 to inlet 54 of separator unit 56 that includes three-quarter horsepower drive motor 58 and has outlet 60 connected to inlet 24 of separator 26 by feed back line 62 that is always open during system operation. Disposed in feed back line 62 are flow meter 64 and valve 66 that provides a variation in flow in feedback line between 0.05 and 0.1 gallon per minute. A second outlet 68 from separator 56 is connected by line 70 and valve 71 to stainless steel three way valve 72 that has a first outlet over line 74 for discharge of processed water (less than fifteen ppm oil and no visible sheen and a second outlet over line 76 for return through strainer 18 to bilge pump 20 for recirculation through the separator system.

Figure 3:
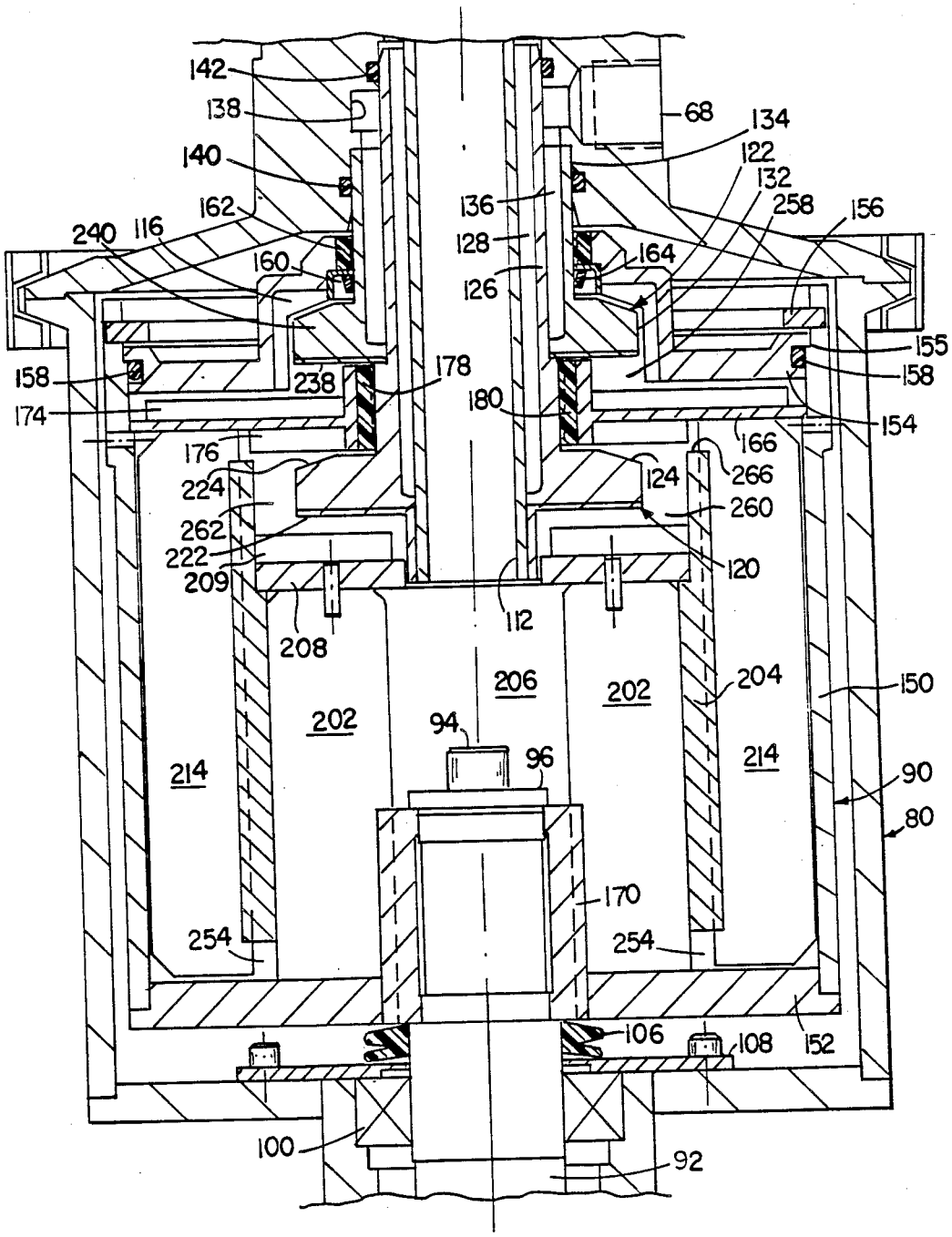
FIG. 3 is an enlarged view of a portion of the separation apparatus shown in FIG. 2.

Further details of separator unit 56 may be seen with reference to FIGS. 2 and 3. That separator includes cylindrical aluminum alloy housing 80 that has an inner diameter of about eighteen centimeters and a depth of about eighteen centimeters with aluminum alloy cover 82 that is secured on housing 80 by retaining clamp 84. Disposed within housing 80 is stainless steel separator bowl assembly 90 that has an outer diameter of about sixteen centimeters and a height of about sixteen centimeters and that is mounted for rotation on drive shaft 92 that is secured to bowl 90 by screw 94 and washer 96. Shaft 92 is supported in tubular housing 98 by bearings 100, 102 and carries V-ring seals 104, 106 that ride on cover plates 108, 110, respectively, and is driven by motor 58.

Cover 82 includes inlet port 54 that is in communication with two centimeter inner diameter inlet tube 112 through tube ports 114, outlet port 58 and outlet port 68. Wing nut 117 cooperates with end plug 118 secured at the end of feed tube assembly 112.

Fixedly secured to feed tube 112 is oil discharge assembly 120 and water discharge assembly 122. Oil discharge assembly 120 includes inlet unit 124 and integral tubular extension 126 that is ten centimeters long and that defines with feed tube 112 an axially extending tubular channel 128 and chamber 130 that is in communication with discharge port 58. Similarly, water discharge assembly 122 includes inlet unit 132 and integral axially extending sleeve 134 that defines with sleeve 126 an axially extending tubular channel 136 that communicates with chamber 138 adjacent water discharge port 68. Elastomer seals 140 and 142 are carried by cover 82 and engage surfaces of sleeves 126 and 134, respectively, and similar upper seals 144 and 146 seal the feed tube 112 and the end plug assembly 118.

Bowl assembly 90 includes cylindrical stainless steel housing member 150 that has a diameter of about sixteen centimeters and a length of about sixteen centimeters, and base 152. Cover member 154 is seated on annular seat 155 of housing member 150 and secured by retaining ring 156. Cover 154 carries elastomer O-ring 158 at its outer periphery that provides a seal with an inner wall surface of housing 150, and two seals 160, 162 at its inner periphery, seal 160 being of the lip type with lip 164 in sealing engagement with axial sleeve portion 134 of the water discharge assembly 122 when the bowl assembly is not being driven in rotation; and seal 162 being a replaceable Delrin ring that is press fitted into the periphery of cap 154 and that has a 2 1/16—16UNS-2A thread formed on its inner periphery, ring 162 having an outer diameter of about six centimeters and an axial length of about eight millimeters. The pitch and hand of the thread is such that as ring 162 rotates against axial extension 134, any flow of liquid that tends to enter that area is forced downwardly by the thread reaction.

Carried within bowl chamber and supported by seat 164 of housing member 150 is divider member 166 that has a diameter of about fifteen centimeters with four support lips 168 (FIG. 7) at its periphery; a set of eight vanes 174 on its upper surface, each of which has a length of about 4.5 centimeters, a similar set of vanes 176 at its lower surface of length about 2.5 centimeters in length and a flange portion 178 at its inner periphery that has a diameter of about five centimeters and a height of about two centimeters and receives Delrin seal ring 180 that has a height of two centimeters and an inner diameter of about 4.4 centimeters with a left hand thread in its lower portion and a right hand thread in its upper portion—each thread being 16UN 2A. The threaded seal ring 180 is carried in rotation by divider member 166 and its threads force liquid tending to enter at either end of the seal ring in the opposite axial direction to maintain division of liquids in the chambers 256 and 260 above and below divider member 166.

Figure 4:
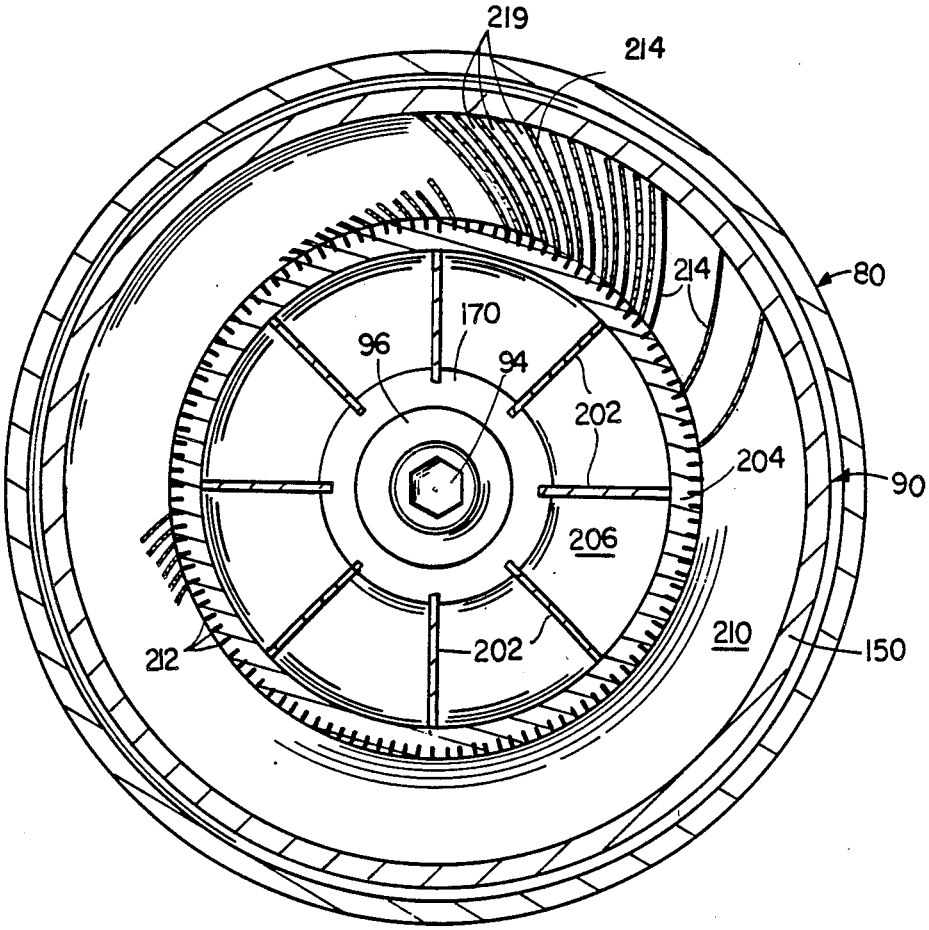
FIG. 4 is a sectional view taken along the line 4—4 of FIG. 2.

FIG. 4 is a sectional view through the separator housing and rotatable bowl structures. Bowl assembly 90 includes sleeve 170 to which drive shaft 92 is keyed and secured with bolt 94. An array of eight radially extending vanes 202 is fixed to sleeve 170 and base 152. Coaxially disposed within cylindrical bowl 90 is flow accelerating chamber structure that includes cylindrical stainless steel tube 204 of eleven centimeters outer diameter that defines an accelerating chamber 206 and cover plate 208 that receives the upper ends of accelerating vanes 202. Secured on the upper surface of cover 208 are a series of eight radially extending vanes 209 (FIG. 3), each of which has a width of about three millimeters. The outer surface of separator wall 204 and the inner surface of outer bowl 90 are spaced apart a radial distance of about 4.5 centimeters and defines a separating chamber 210. Formed in the outer wall of cylinder 204 is an array of one hundred twenty equally-spaced vertically extending slots 212, each of which is about one quarter millimeter wide and two millimeters deep.

Disposed in each peripheral slot 212 is a flexible coalescing sheet vane 214 of polypropylene with a density substantially the same as water. End and elevational views of a separator vane sheet 214 are shown in FIGS. 5 and 6. Each vane sheet 214 has a height of about 12.5 centimeters so that it extends substantially the entire distance between base plate 152 and divider member 166. Each vane sheet 214 has a length of about 9.4 centimeters and a thickness of about 0.2 millimeter with a body portion 216 and an end strip portion 218 at a 60° angle from body portion 216. Formed on the body portion 216 of each sheet is an array of spacer dimples 220 of about three millimeters diameter and about one millimeter height spaced on 1.2 centimeter centers. End strip portion 218 of each coalescing vane 214 is secured in a slot 212 with its body portion 216 extending at a 30° angle to a tangent to the outer surface of cylinder 204. The vane sheets 214 are smoothly curved in spaced spiral array and together provide a set of spiral coalescing channels 219 in separating chamber 210.

A sectional view of the oil discharge assembly 120 disposed above accelerating chamber 206 is shown in FIG. 7. With reference to FIGS. 3 and 7, discharge assembly 120 includes cap member 222 and pitot body 224. Formed in body 224 are flow channels 226, 228 of spiral configuration that extend from peripheral inlet ports 230, 232, respectively, (in communication with chamber 260) to internal discharge ports 234, 236 that communicate with axial flow channel 128 that surrounds inlet pipe 112.

Details of the similar water discharge assembly 122 may be seen with reference to FIG. 8. Inlet unit 132 similarly includes a cap 238 and a body member 240 with spiral channels 242, 244 that extends from inlet ports 246, 248 at its periphery (in communication with chamber 258) to discharge ports 250, 252 at its inner which communicate with flow channel 136 for flow of water to chamber 138 and discharge through port 68. Cap 238 is secured on the end surface of pitot body member 240 by a bonding agent and screws.

With reference again to FIGS. 2 and 3, the feed mixture from separator 26 is introduced through inlet port 54 for flow down feed tube 112 and into the accelerating chamber 206 of the bowl assembly 90 where it is accelerated radially by vanes 202 and flows through passages 254 at the lower end of sleeve 204 for entrance into the separating chamber 210 for flow under centrifugal force along spiral vanes 214. The heavier components (e.g., water) are displaced outwardly and the lighter components (e.g. oil) are displaced inwardly due to centrifugal actions. The heavier (water) component thus migrates to the outer periphery of separating chamber 210 and rises for discharge at the upper end of vanes 214 through the peripheral slots 256 (FIG. 7) in divider member 166 into the chamber 258 above divider plate 166 where its accelerated flow as influenced by the radial vanes 116 and 174 is directed to the inlets 246, 248 of the upper (water) discharge assembly 122, the momentum of the flowing liquid then carrying it through the spiral passages 242, 244 and the axially extending passage 136 for discharge through outlet port 68. Similarly, the lighter (oil) component passes over the upper end 266 of sleeve 204 into chamber 260 below divider 166 and with its rotary motion guided by vanes 176 and 209 flows into the spiral passages 226, 228 of the lower discharge assembly 120 for discharge through axial channel 128 and annular chamber 130 to discharge port 58.

As dynamic seal ring 162 is carried in rotation by cover 154, it rotates against axial extension 134, and any flow of liquid that tends to enter that area is forced downwardly by the thread reaction. Similarly, as dynamic seal ring 180 is carried in rotation by divider member 166, its threads force liquid tending to enter at either end of the seal ring in the opposite axial direction to maintain division of liquids in the chambers 256 and 260 above and below divider member 166. When the bowl assembly is not being driven in rotation, the lip 164 of seal 160 is in sealing engagement with axial sleeve portion 134 of the water discharge assembly 122 and seals the bowls chambers 256 and 260 from the housing 80, thus facilitating activities such as reverse flushing.

With reference to FIG. 1, in system startup, bilge pump 20 is primed with water through strainer 18, control valve 40 is closed, control valve 50 is open, and the three way valve 72 is connected to recirculation line 76. Motor 58 brings the separator bowl 90 up to speed (3600 rpm) and the bilge pump 20 is energized. The system components are filled with water (as indicated by the gauges indicating positive pressures) and the oil discharge flow rate (line 62) is set at 0.05 gallon per minute using the flow meter 64 and control valve 66. When the flows and pressures have stabilized, three way valve 72 is switched to the discharge mode to connect separator outlet 68 to output line 74 and the discharge pressure valve 71 is set to approximately five psig. The continuous feedback flow, monitored by meter 64, is in the range of 0.05 to 0.1 gallon per minute in typical operation of this system. The discharged water (line 74) contains less than fifteen parts per million oil and no visible sheen.

Solenoid valves 40, 50 control oil and water discharges, respectively, from separator 26 with only one valve open at any time. As separated oil accumulates in the cylindrical tower 38, it displaces the water phase and significantly changes the conductivity level measured by electrodes 42, 44. When electrode 44 senses oil, it signals the oil discharge valve 40 to open and the water discharge valve 50 to close. After sufficient volume of oil has been removed from tower 38 as indicated by electrode 42, valves 40, 50 are cycled back to their previous position with water valve 50 open and oil valve 40 closed to continue discharge of water over line 34 to secondary separator 56. The pressure relief valve 27 at the outlet of the bilge pump 20 opens at seven psig and the pressure relief valve 46 at the outlet of the plate separator 26 also opens at seven psig.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. Separation apparatus comprising housing structure, a bowl assembly mounted for rotation in said housing structure, means for rotating said bowl assembly at a speed of at least one thousand rpm, said bowl assembly including structure defining an inlet, structure defining an inner chamber region, a plurality of accelerating vanes disposed in said inner chamber region, structure defining an outer chamber region surrounding said inner chamber region, a circumferential array of coalescing vanes disposed in said outer chamber region, each said coalescing vane being disposed along a path that extends circumferentially between the inner and outer walls of said outer chamber region, passage structure providing communication between said inner chamber region and the axial inlet end of said outer chamber region, first outlet passage structure at the axial outlet end of said outer chamber region adjacent the outer periphery thereof for flowing a separated heavy constituent of the mixture from said outer chamber region, and second outlet passage structure at the axial outlet end of said outer chamber region adjacent the inner periphery thereof for flowing a separated light constituent of the mixture from said outer chamber region, first fixed discharge structure in communication with said first outlet passage structure for receiving said separated heavy constituent and discharging said separated heavy constituent from said separation apparatus, second fixed discharge structure in communication with said second outlet passage structure for receiving and discharging said lighter constituent from said separation apparatus, and dynamic seal structure carried by said bowl assembly and cooperating with said first and second fixed discharge structures for maintaining separation between said light and heavy constituents applied to said first and second discharge structures from said first and second outlet passages.

2. The apparatus of claim 1 wherein said first and second fixed discharge structures each include a tubular discharge passage, said tubular discharge passages being disposed in coaxial relation, and said inlet includes a tubular conduit coaxially disposed within said tubular discharge passages.

3. The apparatus of claim 1 wherein said dynamic seal structure includes a member with spiral groove structure disposed in running engagement with a cylindrical outer surface of one of said fixed discharge structures.

4. The apparatus of claim 1 wherein each said fixed discharge structure includes a body member in which are formed plurality of flow channels of spiral configuration that extend inwardly from inlet ports at the periphery of said discharge structure to discharge ports adjacent the center of the discharge structure and that communicate with an axially extending flow passage structure.

5. The apparatus of claim 1 and further including lip seal structure cooperating with said discharge structure for maintaining separation between said housing and said bowl assembly when said bowl assembly is not being driven in rotation.

6. The apparatus of claim 1 wherein said inner and said outer chamber defining structures include a cylindrical member that divides said inner and outer chamber regions, and said coalescing vanes are of polymeric material, are at least fifty in number, are disposed in circumferential array and are fixedly attached to said cylindrical member.

7. The apparatus of claim 1 wherein the density of said coalescing vanes is substantially the same as the density of water.

8. The apparatus of claim 7 wherein said inner and said outer chamber defining structures include a cylindrical member that divides said inner and outer chamber regions, each said coalescing vane is a sheet member of oleophillic polymeric material with an array of spaced protuberances on a surface thereof, and said coalescing vanes are at least fifty in number, are disposed in circumferential array and are fixedly attached to said cylindrical member.

9. The apparatus of claim 8 wherein said dynamic seal structure includes a member of polymeric material with spiral groove structure disposed for running engagement with a cylindrical outer surface of one of said fixed discharge structures when said bowl assembly is being driven in rotation, and further including lip seal structure cooperating with said fixed discharge structure for maintaining separation between said housing and said bowl assembly when said bowl assembly is not being driven in rotation.

10. The apparatus of claim 9 wherein said first and second fixed discharge structures each include a tubular discharge passage, said tubular discharge passages being disposed in coaxial relation, and said inlet includes a tubular conduit coaxially disposed within said tubular discharge passages.

11. The apparatus of claim 10 wherein each said fixed discharge structure includes a body member in which a formed plurality of flow channels of spiral configuration that extend inwardly from inlet ports at the periphery of said discharge structure to discharge ports adjacent the center of the discharge structure and that communicate with an axially extending flow passage structure.

12. A liquid separation system comprising a first separator unit that has an inlet, a first outlet for a heavier constituent and a second outlet for a lighter constituent, a second separator unit that has an inlet, a first outlet for a heavier constituent and a second outlet for a lighter constituent, a system inlet, means including a pump for flowing a liquid mixture from said system inlet to the inlet of said first separator unit, means connecting said first outlet of said first separator unit to said inlet of said second separator unit, feedback means adapted to provide continuous flow during system operation of at least about 0.01 gallon per minute from said second outlet of said second separator unit to said inlet of said first separator unit, and means connecting said first outlet of said second separator unit to a system outlet.

13. The system as claimed in claim 12 wherein said first separator unit includes a separation chamber and control structure in communication with said separation chamber for receiving said lighter constituent of the mixture, and control means responsive to a predetermined quantity of said lighter constituent in said control structure for discharging a portion of said lighter constituent from said first separator unit.

14. The system as claimed in claim 13 wherein said control structure of said first separator unit includes a tower chamber for receiving said lighter constituent, and a plurality of sensors in said tower chamber for controlling discharge of said lighter constituent from said first separator unit.

15. The system as claimed in claim 12 wherein said first separator unit includes a series of plates for separating said lighter constituent from a heavier constituent of the mixture;

and said second separator unit includes centrifugal means for further separating a lighter constituent of the mixture fed to said second separator unit from said first separator unit.

16. The system as claimed in claim 12 wherein said feedback means includes means for varying the rate of said flow from said second outlet of said second separator unit to said inlet of said first separator unit, and said means connecting said first outlet of said second separator unit to a system outlet includes a three way valve that has a first position connecting said first outlet of said second separator unit to said system outlet and a second position connecting said first outlet of said second separator unit to said inlet of said first separator unit via a feedback line.

17. The system as claimed in claim 12 wherein said system is adapted to separate oil from an oil-water mixture.

18. The system as claimed in claim 12 wherein said second separator unit comprises housing structure, a bowl assembly mounted for rotation in said housing structure, means for rotating said bowl assembly at a speed of at least one thousand rpm, said bowl assembly including structure defining an inlet, structure defining an inner chamber region, a plurality of accelerating vanes disposed in said inner chamber region, structure defining an outer chamber region surrounding said inner chamber region, a circumferential array of coalescing vanes disposed in said outer chamber region, each said coalescing vane being disposed along a path that extends circumferentially between the inner and outer walls of said outer chamber region, passage structure providing communication between that axial inlet end of said inner chamber region with said outer chamber region, first outlet passage structure at the axial outlet end of said outer chamber region adjacent the outer periphery thereof for flowing a separated heavy constituent of the mixture from said outer chamber region, and second outlet passage structure at the axial outlet end of said outer chamber region adjacent the inner periphery thereof for flowing a separated lighter constituent of the mixture from said outer chamber region.

19. The system as claimed in claim 18 wherein said second separator unit further comprises first fixed discharge structure in communication with said first outlet passage structure for receiving said separated heavy constituent and discharging said separated heavy constituent from said second separator unit, and second fixed discharge structure in communication with said second outlet passage structure for receiving and discharging said lighter constituent from said second separator unit.

20. The system as claimed in claim 19 wherein said second separator unit further includes dynamic seal structure carried by said bowl assembly and cooperating with said first and second fixed discharge structures for maintaining separation between said light and heavy constituents applied to said first and second discharge structures from said first and second outlet passages when said bowl assembly is being driven in rotation, and lip seal structure cooperating with said fixed discharge structure for maintaining separation between said housing and said bowl assembly when said bowl assembly is not being driven in rotation.

21. The system as claimed in claim 20 wherein said dynamic seal structure includes a member of polymeric material with spiral groove structure disposed for running engagement with a cylindrical outer surface of one of said fixed discharge structures.

22. The separation apparatus of claim 19 and further including lip seal structure cooperating with said discharge structure for maintaining separation between said housing and said bowl assembly when said bowl assembly is not being driven in rotation.

23. The system of claim 19 wherein said first and second fixed discharge structures each include a tubular discharge passage, said tubular discharge passages being disposed in coaxial relation, and said inlet includes a tubular conduit coaxially disposed within said tubular discharge passages.

24. The system as claimed in claim 18 wherein said inner and said outer chamber defining structures include a cylindrical member that divides said inner and outer chamber regions, and said coalescing vanes are at least fifty in number, are disposed in circumferential array and are fixedly attached to said cylindrical member.

25. The system of claim 24 wherein the density of said coalescing vanes is substantially the same as the density of water, and each said coalescing vane is a sheet member of oleophillic polymeric material with an array of spaced protuberances on a surface thereof.

26. The system as claimed in claim 25 wherein said feedback means includes means for varying the rate of said flow from said second outlet of said second separator unit to said inlet of said first separator unit, and said means connecting said first outlet of said second separator unit to a system outlet includes a three way valve that has a first position connecting said first outlet of said second separator unit to said system outlet and a second position connecting said first outlet of said second separator unit to said inlet of said first separator unit via a feedback line.

27. The system of claim 24 wherein said system is adapted to separate oil from an oil-water mixture, and said means connecting said first outlet of said second separator unit to a system outlet includes a three way valve that has a first position connecting said first outlet of said second separator unit to said system outlet and a second position connecting said first outlet of said second separator unit to said inlet of said first separator unit via a feedback line.

28. The system as claimed in claim 27 wherein said second separator unit further includes first and second dynamic seal structures carried by said bowl assembly and cooperating with said first and second fixed discharge structures for maintaining separation between said light and heavy constituents applied to said first and second discharge structures from said first and second outlet passages when said bowl assembly is being driven in rotation, and lip seal structure cooperating with said fixed discharge structure for maintaining separation between said housing and said driven in rotation.

29. The system as claimed in claim 28 wherein each said dynamic seal structure includes a member of polymeric material with spiral groove structure disposed for running engagement with a cylindrical outer surface of one of said fixed discharge structures.

30. Separation apparatus comprising housing structure, a bowl assembly mounted for rotation in said housing structure, means for rotating said bowl assembly at a speed of at least one thousand rpm, said bowl assembly including structure defining an inlet, structure defining an inner chamber region, structure defining an outer chamber region surrounding said inner chamber region, passage structure providing communication between said inner chamber region and said outer chamber region, first outlet passage structure adjacent the outer periphery of said outer chamber region for flowing a separated heavy constituent of the mixture from said outer chamber region, and second outlet passage structure adjacent the inner periphery of said outer chamber region for flowing a separated light constituent of the mixture from said outer chamber region, first fixed discharge structure in communication with said first outlet passage structure for receiving said separated heavy constituent and discharging said separated heavy constituent from said separation apparatus, second fixed discharge structure in communication with said second outlet passage structure for receiving and discharging said lighter constituent from said separation apparatus, dynamic seal structure carried by said bowl assembly and cooperating with said first and second discharge structures for maintaining separation between said light and heavy constituents applied to said first and second discharge structures from said first and second outlet passages when said bowl assembly is being driven in rotation, and lip seal structure carried by said bowl assembly and cooperating with at least one of said discharge structures for maintaining separation between said housing and said bowl assembly when said bowl assembly is not being driven in rotation.

31. The apparatus of claim 30 wherein said lip seal structure includes a flexible annular member disposed in surrounding relation to said one discharge structure and being arranged to flex outwardly into open condition when said bowl assembly is being driven in rotation.

32. The apparatus of claim 31 wherein said dynamic seal structure includes a member with spiral groove structure disposed in running engagement with a cylindrical outer surface of one of said fixed discharge structures.

* * * * *

UNITED STATES PATENT AND TRADEMARK OFFICE

CERTIFICATE OF CORRECTION

PATENT NO. : 4,973,299

DATED : November 27, 1990

INVENTOR(S) : Leslie S. Rubin et al

It is certified that error appears in the above-identified patent and that said Letters Patent is hereby corrected as shown below:

In the abstract, line 1, "liquid" should be --liquid--.
line 29, "ae" should be --are--.

Col. 1, line 8, change "oil water" to --oil-water--.
Col. 3, line 27, "bilqe" should be --bilge--.
Col. 4, line 65, change "16UN 2A" to --16UN-2A--.
Col. 11, line 16, after "said" (second occurrence), insert --bowl assembly when said bowl assembly is not being--.

Signed and Sealed this

Seventeenth Day of March, 1992

*Attest:*

HARRY F. MANBECK, JR.

*Attesting Officer*

*Commissioner of Patents and Trademarks*